US011553742B2

(12) United States Patent
Eldibany

(10) Patent No.: US 11,553,742 B2
(45) Date of Patent: Jan. 17, 2023

(54) FACE MASK

(71) Applicant: Mohamed Eldibany, Evanston, IL (US)

(72) Inventor: Mohamed Eldibany, Evanston, IL (US)

( * ) Notice: Subject to any disclaimer, the term of this patent is extended or adjusted under 35 U.S.C. 154(b) by 215 days.

(21) Appl. No.: 17/071,834

(22) Filed: Oct. 15, 2020

(65) Prior Publication Data

US 2021/0368874 A1 Dec. 2, 2021

Related U.S. Application Data

(60) Provisional application No. 63/029,904, filed on May 26, 2020.

(51) Int. Cl.

| | |
|---|---|
| ***A41D 13/11*** | (2006.01) |
| ***A62B 18/08*** | (2006.01) |
| ***A62B 23/02*** | (2006.01) |

(52) U.S. Cl.

CPC ..... *A41D 13/1107* (2013.01); *A41D 13/1161* (2013.01)

(58) Field of Classification Search

CPC . A41D 13/11; A41D 13/1107; A41D 13/1115; A41D 13/1123; A41D 13/113; A41D 13/1138; A41D 13/1146; A41D 13/1153; A41D 13/1161; A41D 13/1169; A41D 13/1176; A41D 13/1184; A41D 13/1192; A62B 18/086; A62B 23/025; A62B 23/00; A61M 16/0605; A61M 2210/0618

See application file for complete search history.

(56) References Cited

U.S. PATENT DOCUMENTS 4,969,473 A * 11/1990 Bothwell ..... A41D 13/1153 433/136
5,619,749 A * 4/1997 Banuchi ..... A41D 13/1184 2/427

(Continued)

FOREIGN PATENT DOCUMENTS

KR 20110004962 A * 7/2009 ..... A41D 13/1161
KR 1515326 B1 * 4/2015 ..... A62B 18/025

(Continued)

OTHER PUBLICATIONS

정지원 (Won), Mask, May 8, 2020, All pages (Year: 2020).*

(Continued)

*Primary Examiner* — Rachael E Bredefeld
*Assistant Examiner* — Eric Richard McQuiggan
(74) *Attorney, Agent, or Firm* — Justin Lampel

(57) ABSTRACT

A protective face mask is provided. The protective face mask may have a removable mouth panel (or "apron") which acts as a protective personal barrier for the user. The removable mouth panel is suitable for allowing quick access to the user's mouth to, for example, eat and/or drink without needing to remove the entire body of the mask. Further, the user's nostrils remain secured and protected beneath the remainder of the mask. The mouth panel may also be completely disconnected from the main body of the face mask to allow a user to eat and/or drink. Alternatively, the mouth panel may be partially disconnected from the mask by being rotated to the left, to the right, or upward to allow a user to eat and/or drink.

1 Claim, 9 Drawing Sheets

(56) References Cited

U.S. PATENT DOCUMENTS

| | | | | |
|---|---|---|---|---|
| 6,823,868 | B1 * | 11/2004 | Begum | A41D 13/1192 128/205.27 |
| 7,958,889 | B1 * | 6/2011 | Fernandez-Decastro | A41D 13/11 128/205.27 |
| 10,368,601 | B2 * | 8/2019 | Greenblat | A41D 13/1153 |
| 2006/0283454 | A1 * | 12/2006 | Delaney | A41D 13/1161 128/206.28 |
| 2007/0215160 | A1 * | 9/2007 | Viljanen | A41D 13/11 128/205.27 |
| 2014/0041671 | A1 * | 2/2014 | Kumar | A41D 13/1161 29/428 |
| 2015/0040910 | A1 * | 2/2015 | Koehler | A62B 23/02 128/205.27 |
| 2019/0090558 | A1 * | 3/2019 | Xu | A41D 13/1176 |
| 2020/0329792 | A1 * | 10/2020 | Howard | A41D 13/11 |
| 2021/0329993 | A1 * | 10/2021 | Mallady, Jr. | A41D 13/1107 |
| 2022/0016452 | A1 * | 1/2022 | Weiss | A41D 13/11 |
| 2022/0071317 | A1 * | 3/2022 | Isgar | A42B 3/30 |
| 2022/0167691 | A1 * | 6/2022 | Watts | A41D 13/11 |
| 2022/0176170 | A1 * | 6/2022 | Daniels | A41D 13/1107 |

FOREIGN PATENT DOCUMENTS

| | | | | |
|---|---|---|---|---|
| KR | 20200116432 | * | 5/2020 | A62B 18/084 |
| WO | WO-2005044029 | A2 * | 5/2005 | A41D 13/11 |

OTHER PUBLICATIONS

채성원 (Jung), A dust mask, Mar. 14, 2014 (Year: 2014).*

* cited by examiner

FACE MASK

REFERENCE TO RELATED APPLICATIONS

This application claims priority to U.S. Provisional Application No. 63/029,904 titled "PROTECTIVE FACE MASK" which was filed on May 26, 2020, the entire contents of which are incorporated by reference herein.

BACKGROUND OF THE INVENTION

A protective face mask is provided. The protective face mask may have a removable mouth panel (or "apron") which acts as a protective personal barrier for the user. The removable mouth panel is suitable for allowing quick access to the user's mouth to, for example, eat and/or drink without needing to remove the entire body of the mask. Further, the user's nostrils remain secured and protected beneath the remainder of the mask. The mouth panel may also be completely disconnected from the main body of the face mask to allow a user to eat and/or drink. Alternatively, the mouth panel may be partially disconnected from the mask by being rotated to the left, to the right or upward to allow a user to eat and/or drink. The protective face mask is suitable for personal protection and aids in the reduction of the spread of bacteria, virus, dust and other harmful, items that might occur at construction sites or at concerts, festivals, theaters, airplanes, sporting events or other crowded areas.

Protective face masks are common. For example, U.S. Pat. No. 7,044,127 to Fernandez discloses a protective, multipurpose mask which covers the oral and nasal areas. The mask has an opening about or around the mouth area of the wearer which allows different devices to be inserted and withdrawn from the wearer's mouth while the mask is in place on the wearer.

Further, U.S. Pat. No. 6,718,971 to Horn discloses a feeding apparatus for breathing masks that allows food and drink intake when the mask is in use, does not reduce the wearer's field of vision, requires little space, and is protected from dirt or other contamination. It is the problem of this invention to provide a feeding apparatus for breathing masks that does not reduce the wearer's field of vision, is protected from dirt or other contamination and allows for contamination-free insertion of a drinking cannula, if required. The problem of the invention is solved by placing a pivoting check valve (1) that can be closed using a sealing cap (5) and tightly encompasses a hollow axle (2) in a fitting 4 on the outside of the breathing mask. The hollow shaft (2) of the feeding apparatus is equipped with a hose and mouthpiece (3) on its end inside the breathing mask.

Still further, U.S. Pat. No. 5,701,892 to Bledstein discloses a multipurpose face mask made of supple material covers the nose, mouth, and chin with a two sided chamber held away from the entrance of the nostrils and the mouth by a rigid support attached inside the vertical front fold. This rigid support makes possible the use of a wide variety of soft materials in one or more layers, which may serve to filter dust, pollen, mold, dander, powder, and other common airborne particles, and/or to warm and humidify cold, dry air. For versatility in purpose, a disposable version may fit inside a reusable version. The cold weather version may have air holes in the outer layer. This device of supple material can be made in several sizes and rolled to fit in a pocket or purse and has an attractive, lean appearance with potential for embellishment. This invention in its many forms enhances the lives of people with respiratory disorders or professions which require respiratory protection.

However, these patents fail to describe a protective face mask which is easy to use as described herein by the present face mask. Further, these patents fail to provide for a protective face mask which allows a user to effectively eat or drink while keeping the main body of the mask secured to the user's face.

SUMMARY OF THE INVENTION

A protective face mask is provided. The protective face mask may have a removable mouth panel (or "apron") which acts as a protective personal barrier for the user. The removable mouth panel is suitable for allowing quick access to the user's mouth to, for example, eat and/or drink without needing to remove the entire body of the mask. Further, the user's nostrils remain secured and protected beneath the remainder of the mask. The mouth panel may also be completely disconnected from the main body of the face mask to allow a user to eat and/or drink. Alternatively, the mouth panel may be partially disconnected from the mask by being rotated to the left, to the right, or upward to allow a user to eat and/or drink. The protective face mask is suitable for personal protection and aids in the reduction of the spread of bacteria, virus, dust, and other harmful items that might occur at construction sites or at concerts, festivals, theaters, airplanes, sporting events, or other crowded areas.

An advantage of the present face mask is that the present face mask allows a user to keep the main body of the face mask on while eating or drinking. More specifically, the main body of the mask remains over the user's nose and protects both the user and any people around the user from, for example, sneezing or infectious droplets, while the mouth panel (or "apron") is either rotated or removed.

Yet another advantage of the present face mask is that the present face mask may have an elastic band for securing the protective face mask to the head of a user in a quick and efficient manner. The elastic band may seal the mask against the user's skin, below the nose bridge, effectively sealing the top nasal compartment from the bottom (or mouth) compartment.

Another advantage of the present face mask is that the present face mask may have a hook and loop fastener system for rotating the mouth panel or completely swapping out a mouth panel of the face mask. In one embodiment, magnetic strips or snaps may be used.

Still another advantage of the present face mask is that the present face mask may allow a user to enjoy a drink and a snack in a crowded space or gathering without having to remove his/her entire mask.

Another advantage of the present face mask is that the present face mask may be suitable for musicians playing air instruments.

For a more complete understanding of the above listed features and advantages of the protective face mask reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A protective face mask is provided. The protective face mask may have a removable mouth panel (or "apron") which acts as a protective personal barrier for the user. The removable mouth panel is suitable for allowing quick access to the user's mouth to, for example, eat and/or drink without needing to remove the entire body of the mask. Further, the user's nostrils remain secured and protected beneath the remainder of the mask. The mouth panel may also be completely disconnected from the main body of the face mask to allow a user to eat and/or drink. Alternatively, the mouth panel may be partially disconnected from the mask by being rotated to the left, to the right or upward to allow a user to eat and/or drink. The protective face mask is suitable for personal protection and aids in the reduction of the spread of bacteria, virus, dust, and other harmful items that might occur at construction sites or at concerts, festivals, theaters, airplanes, sporting events or other crowded areas.

Figure 1:
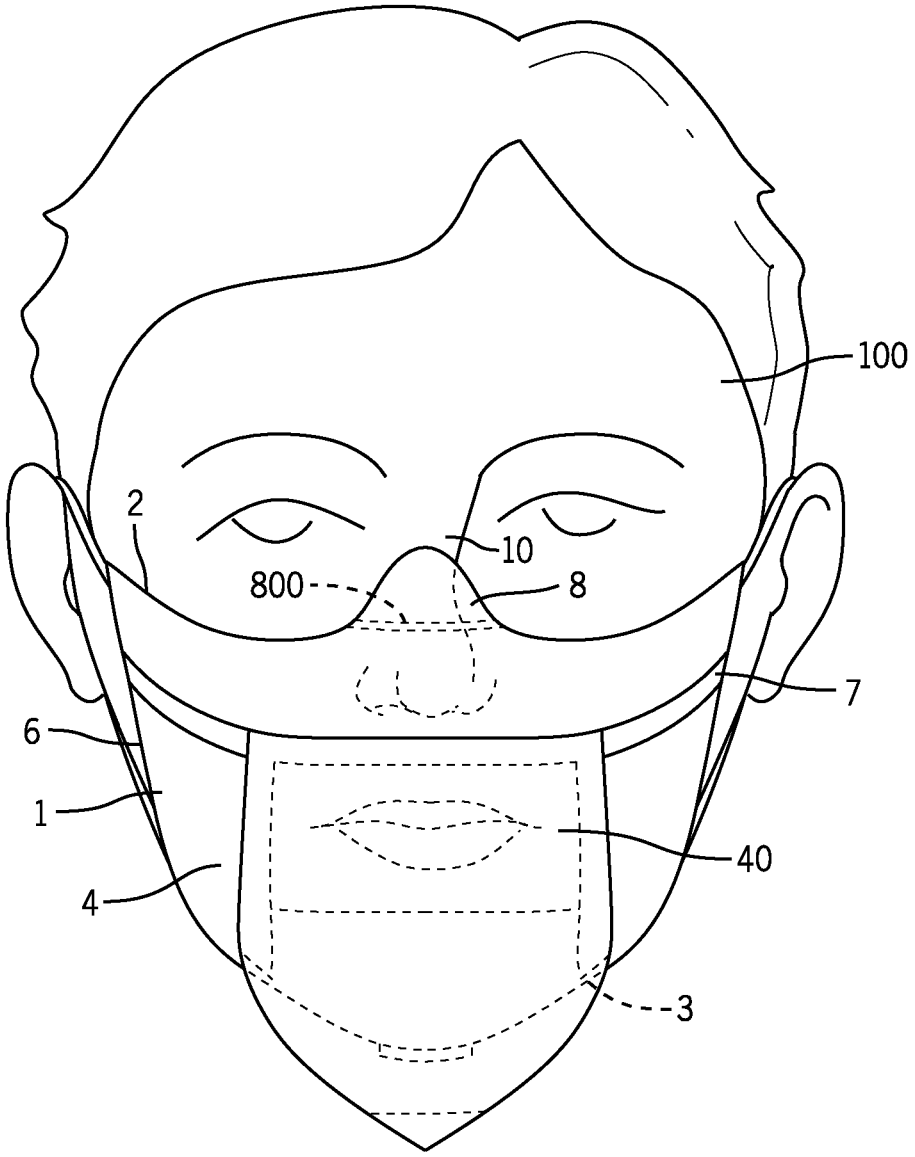
FIG. 1 illustrates a front view of a user wearing the protective face mask in one embodiment wherein the face mask is in the first orientation.
Figure 3:
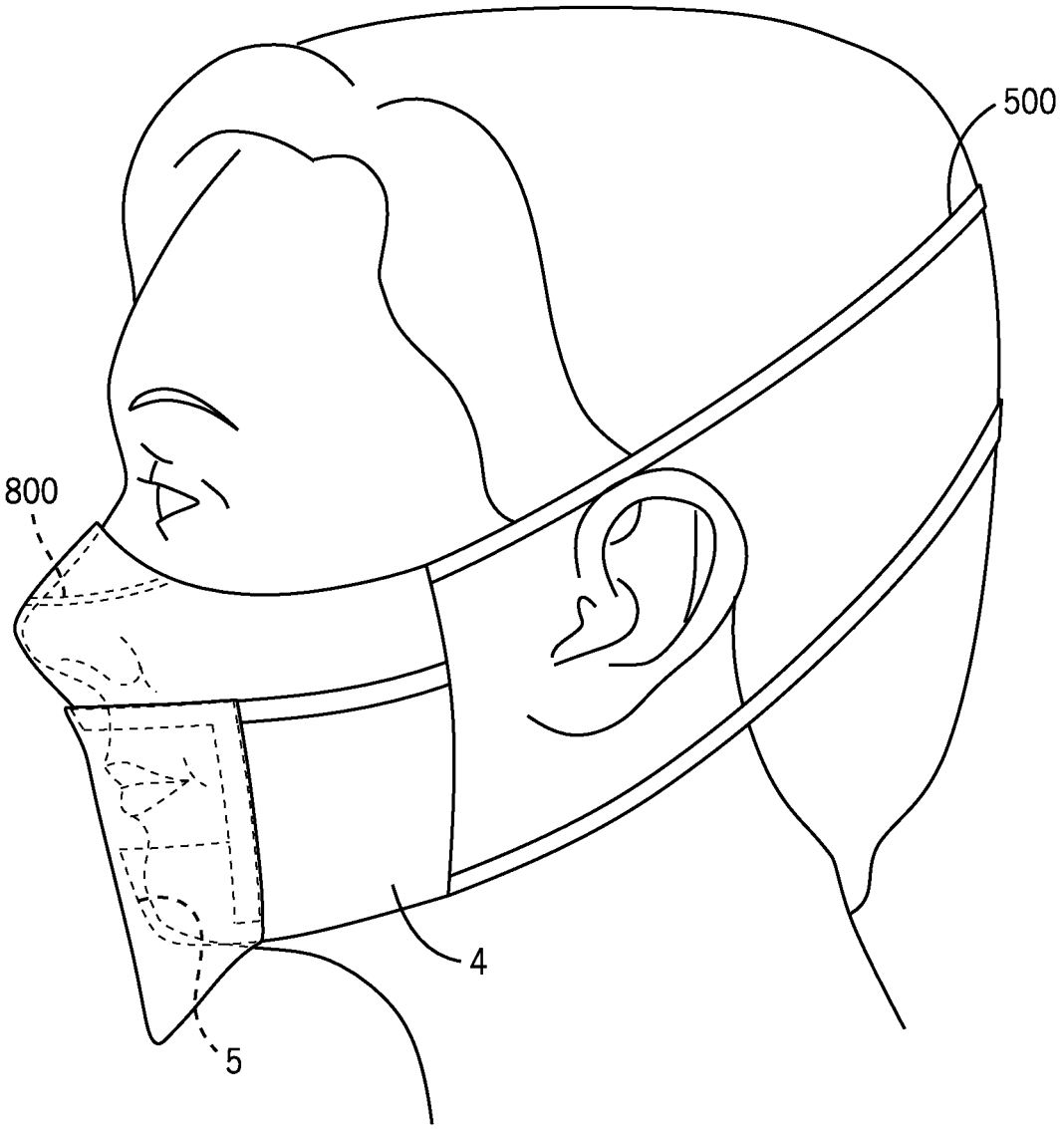
FIG. 3 illustrates a side view of a user wearing the protective face mask in one embodiment wherein the face mask is in the first orientation.

Referring first to FIG. 1, a protective face mask 1 is provided. The protective face mask 1 may have a main body panel having a top 2, a bottom 3, a front surface 4, a back surface 5 (FIG. 3), a first side 6 and a second side 7. Preferably, the protective face mask 1 is made of a durable and washable material. The material may be a breathable material having a high filtration rate. Further, in an embodiment, the protective face mask 1 is made of a material which substantially prevents the passage of bacteria, viruses, dust or other items from the front surface 4 to the back surface 5 of the mask 1. As a result, the protective face mask 1 is ideal for protecting a user from being exposed to dangerous bacteria, viruses, dust, or other material while the face mask 1 is being worn by the user, but allows for the user to safely eat and drink. The main body of the mask remains over the user's nose and protects both the user and any people around the user from, for example, sneezing or infectious droplets, while the mouth panel (or "apron") is either rotated or removed.

In an embodiment, the top 2 of the protective face mask 1 extends high enough to cover at least the bottom portion of the nose 10 of a person 100, as is shown in FIG. 1. Further, in one embodiment, the top 2 of the present face mask 1 may have a, for example, triangular extension 8 which covers at least a portion of the bridge of a person's nose 10 to better keep the face mask 1 in position and better prevent dangerous materials (like viruses and bacteria) from entering the nose 10. In an embodiment, the triangular extension 8 is made of a durable, malleable plate or may have a malleable wire 800 (FIG. 1) which molds around the nose bridge and provides a close tailored fit wherein the malleable wire 800 is located on or within an interior of the face mask 1.

Figure 2:
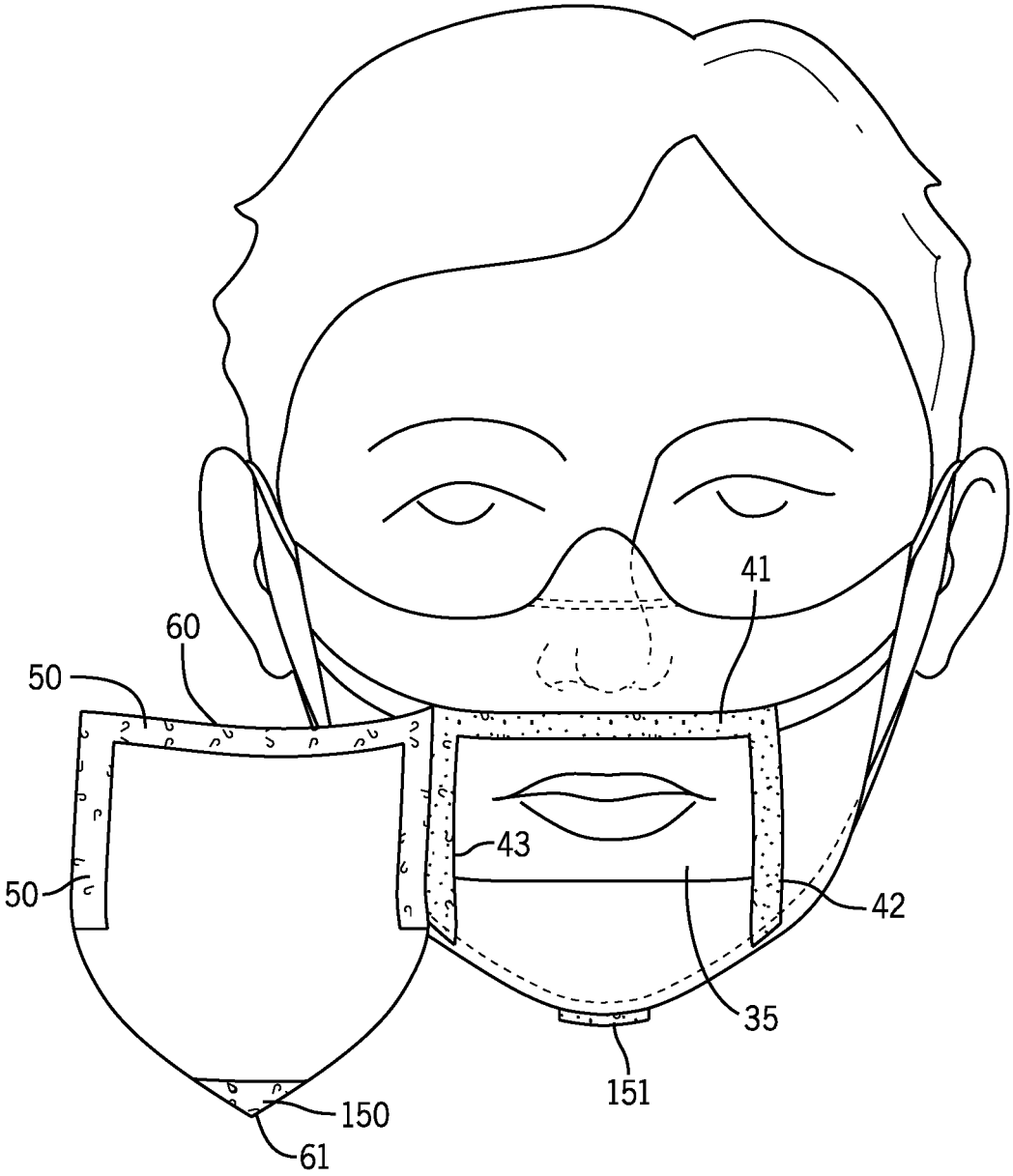
FIG. 2 illustrates a front view of a user wearing the protective face mask in one embodiment wherein the face mask is in a second orientation wherein the mouth panel is opened to the left (or the person's right in the actual figure).

As shown in FIG. 2, in an embodiment, the front 4 of the face mask 1 may have a plurality of hook and loop fastener strips (or magnetic strip system in an alternative embodiment). In particular, a generally horizontal strip 41 may be located above a mouth opening 35 of the face mask 1. First side strip 42 and a second side strip 43 may be located on the sides of the mouth opening 35. The hook and loop fastener strips 41, 42 and 43 may allow a removable and flexible mouth panel (or "apron") 40 to be temporarily, but protectively secured to the strips 41, 42 and 43. In particular, a corresponding hook and loop fastener system 50 is located on the back side of the mouth panel 40. In one embodiment, magnetic strips or snaps may be used as opposed to the hook and loop fastener system.

In an embodiment, the mouth panel (or "apron") 40 may be of various shapes and sizes and may have various print patterns and may be interchangeable so that a user 100 may select from different style choices. Further, the size and shape of the mouth panel 40 may vary depending on the user's 100 preference, including, in an embodiment, the shape of a shield. The mouth panel 40 may also minimize the potential spread of the user breath to others, especially when used in the upward position, by pushing breath downward and absorbing/filtering moisture.

In an embodiment, at least the apron 40 portion is transparent. More specifically, having at least the apron portion 40 be transparent allows for increased communication by allowing others to see the movement of the wearer's mouth. This is especially true for hearing impaired individuals who need to see the movement of a person's lips in order to fully understand the individual.

A user may elect to secure the mouth panel 40 to all three strips 41, 42 and 43 to completely cover the mouth opening 35 when the face mask 1 is being normally worn. If a user 100 wants or needs to temporarily fully expose his/her mouth, the user 100 may either un-peal or un-secure the top strip 41 and a side strip 42 or 43 of the hook and loop fastener so that the mouth panel 40 may be rotated to the side (in a second orientation as shown in FIG. 2). This will allow a user 100 to quickly eat or drink an item. Alternatively, a user may partially or fully un-peal the two side strips 42, 43 while keeping the top strip 41 in place to rotate the mouth panel (or "apron") 40 upward, as is shown in FIG. 5 so the apron protection remains. Again, exposing the mouth allows a user to drink or eat before returning the protective face mask 1 to the first orientation of FIG. 1 which is the more protective orientation. Because, in one embodiment, the mouth panel 40 may lack a bottom hook and loop fastener strip, the user 100 may use the face mask 1 in the fully attached first orientation of FIG. 4 while still utilizing a straw to drink.

Figure 4:
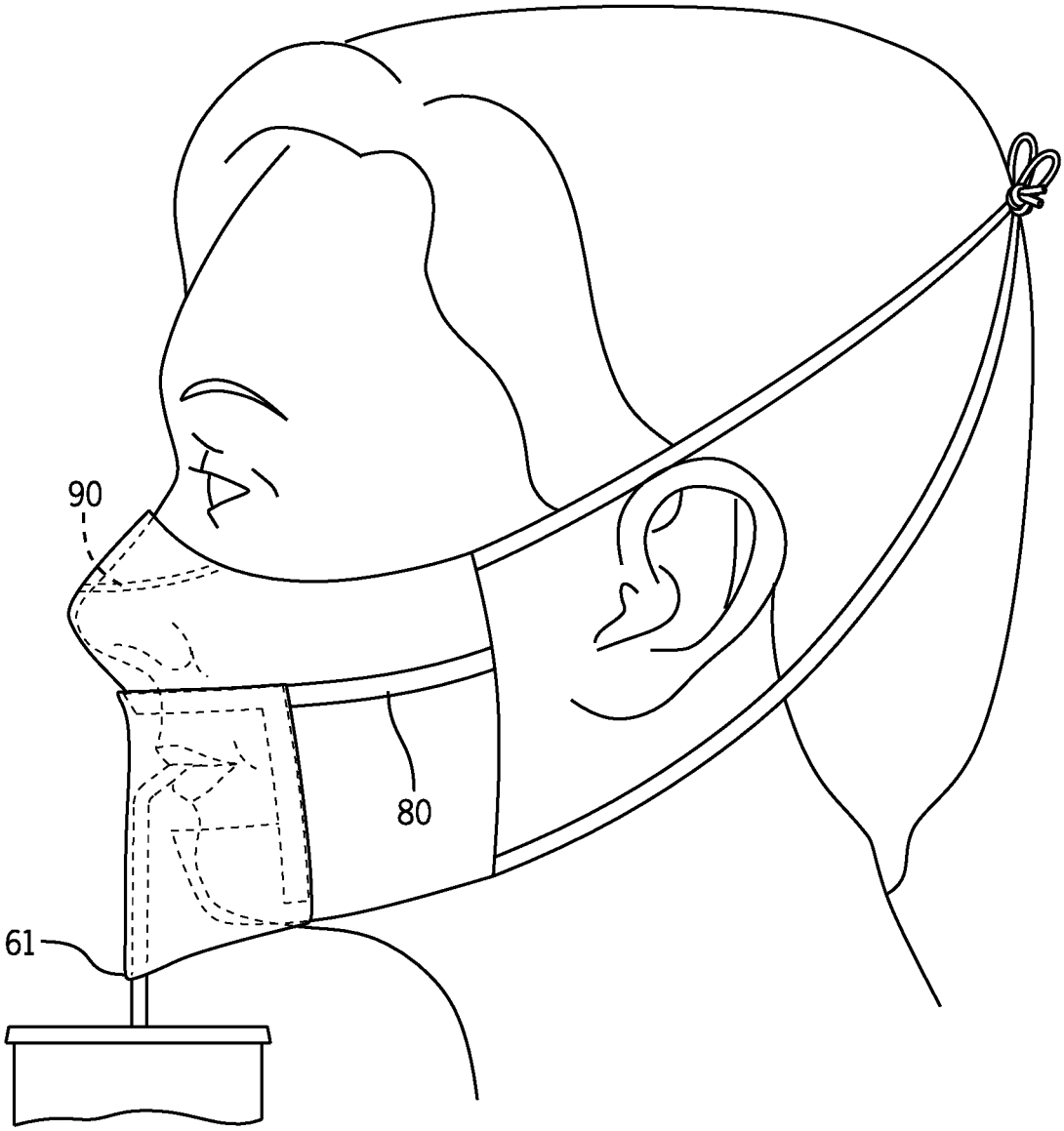
FIG. 4 illustrates a side view of a user wearing the protective face mask in one embodiment wherein a user is drinking through a straw under the mouth panel (or "apron") of the face mask while the mouth panel remains fully connected to the mouth straps.
Figure 5:
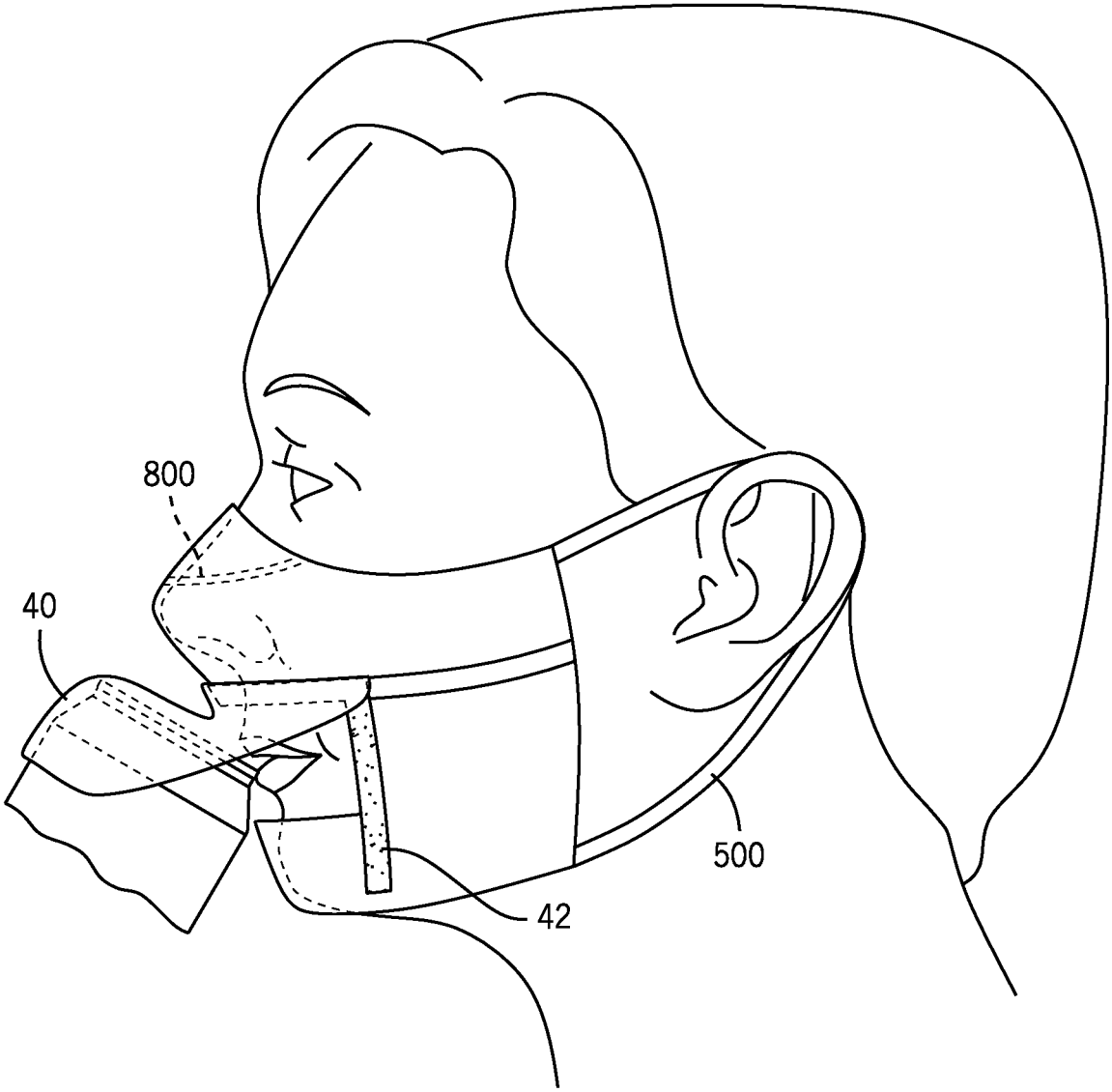
FIG. 5 illustrates a side view of a user wearing the protective face mask in one embodiment wherein a user is drinking through a can while the mouth panel is only connected to the top mouth strap of the face mask.
Figure 6:
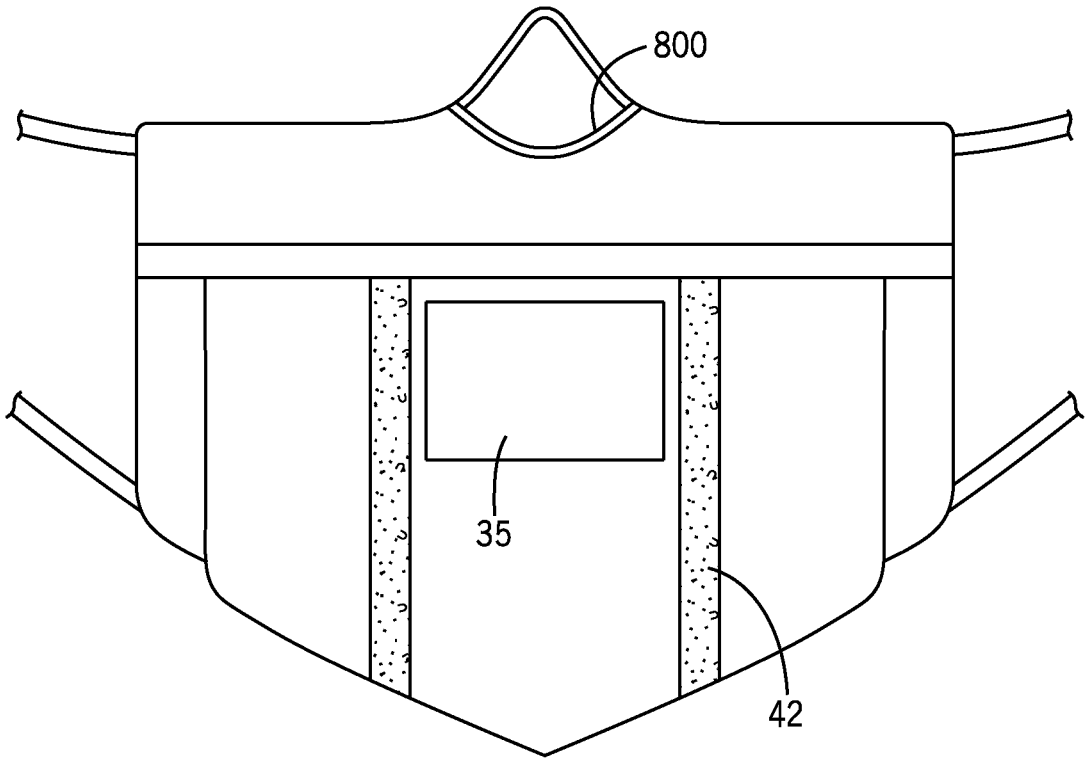
FIG. 6 illustrates a flat view of the protective face mask in one embodiment.
Figure 7:
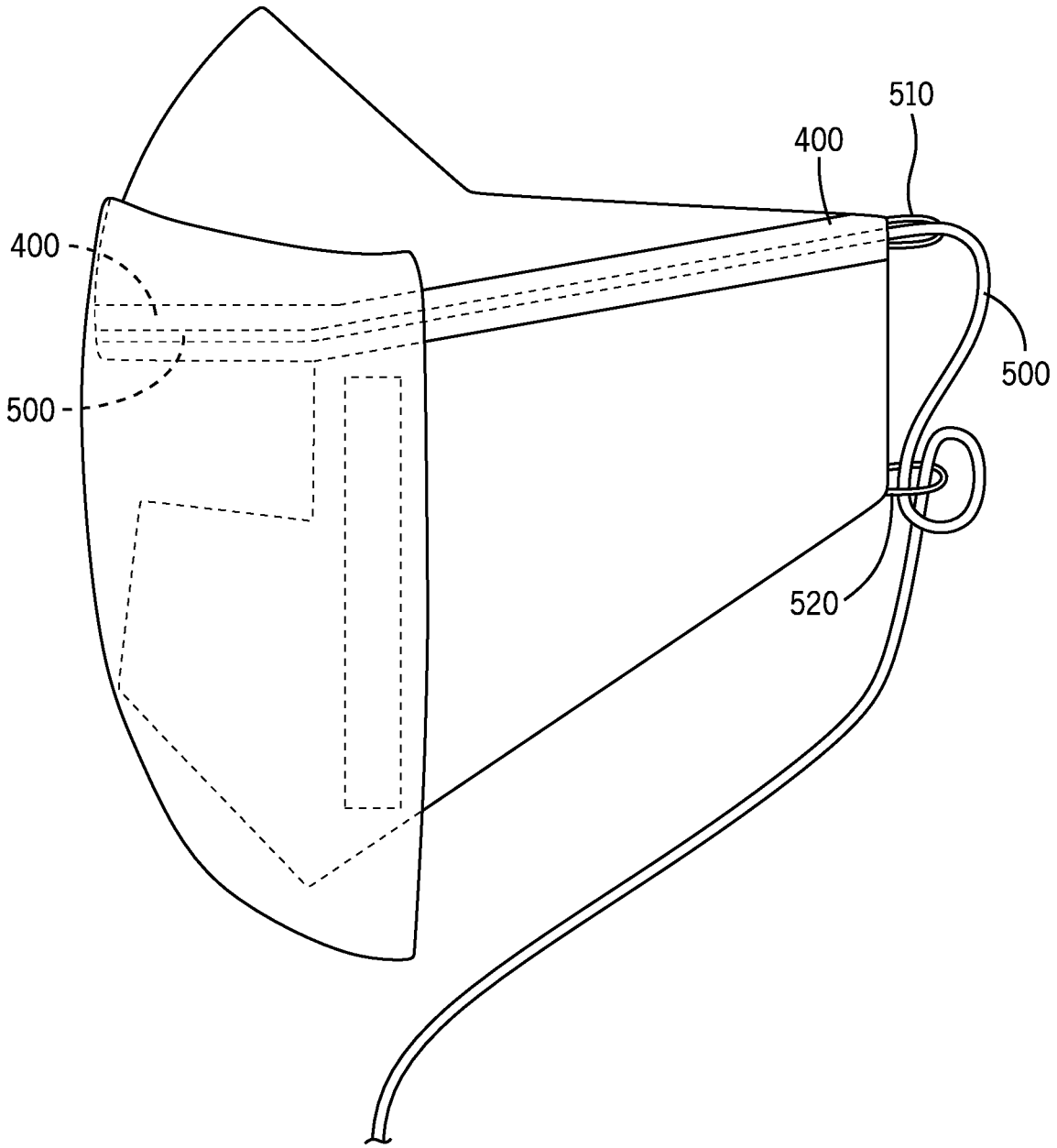
FIG. 7 illustrates an alternative embodiment of the face mask wherein a securing strap is visible within a securing strap channel of the face mask.

Referring now to FIG. 4, in an embodiment, the face mask 1 may have an optional elastic band 80 and an optional internal malleable metal wire or plate 90. The optional elastic band 80 may allow the mask 1 to be quickly and securely attached to a user's 100 face. The optional metal wire 90 may be, for example, triangular shape so that the triangular nose extension 8 remains properly aligned. The elastic band 80 may seal the mask against the user's skin, below the nose bridge, effectively sealing the top nasal compartments from the bottom (or mouth compartment).

Referring now to FIG. 2, in an alternative embodiment, the mouth panel 40 may have a top 60 and a bottom 61 fastener attachment. Preferably, the mouth panel 40 is triangular in shape; although alternative shapes may be used. The bottom 61 of the mouth panel 40 may have an optional securing mechanism 150 which correspondingly mates with an opposing securing mechanism 151 located on the front 4 of the face 1, at the bottom 3 of the mask (near or under the chin of the person). The bottom securing mechanism 151 may be the only securing mechanism 151 not physically connected to the sides 42, 43 and top 41 strip securing mechanisms.

The securing mechanism 150, 151 may also be a hook and look fastener system. In an embodiment, a user 100 may wear the mouth panel 40 hanging down (as shown in FIG. 1 or a user 100 may secure the securing mechanism 150, 151 together so that the mouth panel 40 gets tucked under the chin (orientation not shown). In an embodiment, the mouth panel 40 is completely removable from the front 4 of the face mask 1 to washing, replacing or substituting the mouth panel for a different mouth panel having a different style.

In an embodiment, the top nose compartment may also have a separate opening and may also have a rotatable, removable panel (or "apron") similar to the mouth panel. Still further, in an embodiment, the nose may always remain covered (lacking a panel) while the mouth opening has the herein described removable/rotatable panel.

Figure 8:
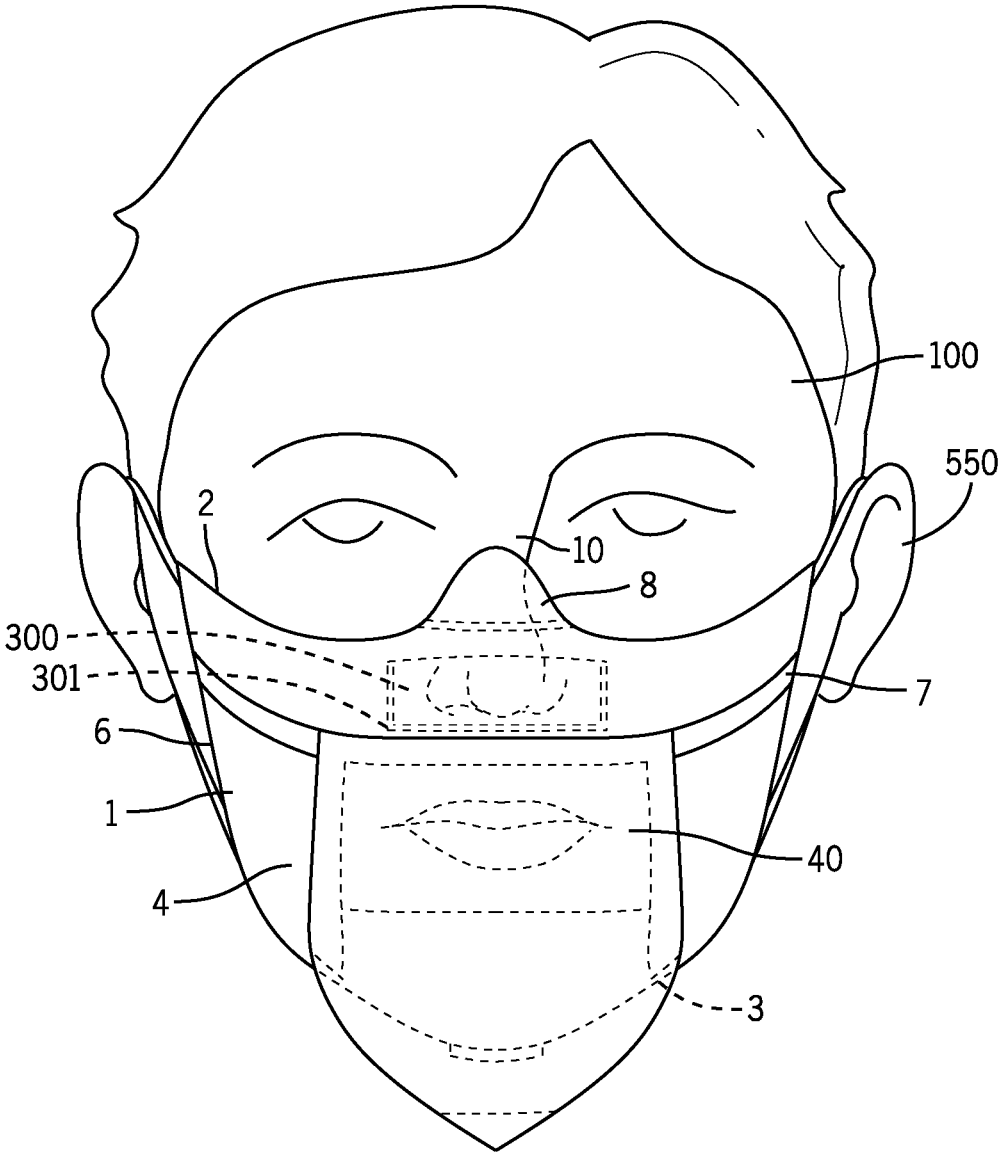
FIG. 8 illustrates an alternative embodiment of the face mask wherein a second removable/rotatable nose compartment is illustrated.

Referring now to FIG. 8, in an embodiment, the face mask 1 may have a second removable/rotatable portion. In particular, a nose covering panel 300 (or "second panel") may be connected to a securing strip 301 of the face mask 1. The nose covering panel 300 may work in substantially the same manner as the main panel 40 described above. More specifically, a user may completely remove the nose panel 300 exposing an opening for the user's nose 10 while keeping the main panel 40 in place, a user may rotate the nose panel 300 upward or to one side (in a similar manner as the main panel), or a user may leave the nose panel 300 completely secured to the face mask 1 and therein completely covering the nose opening while still using the main panel 40 as described above.

Figure 9:
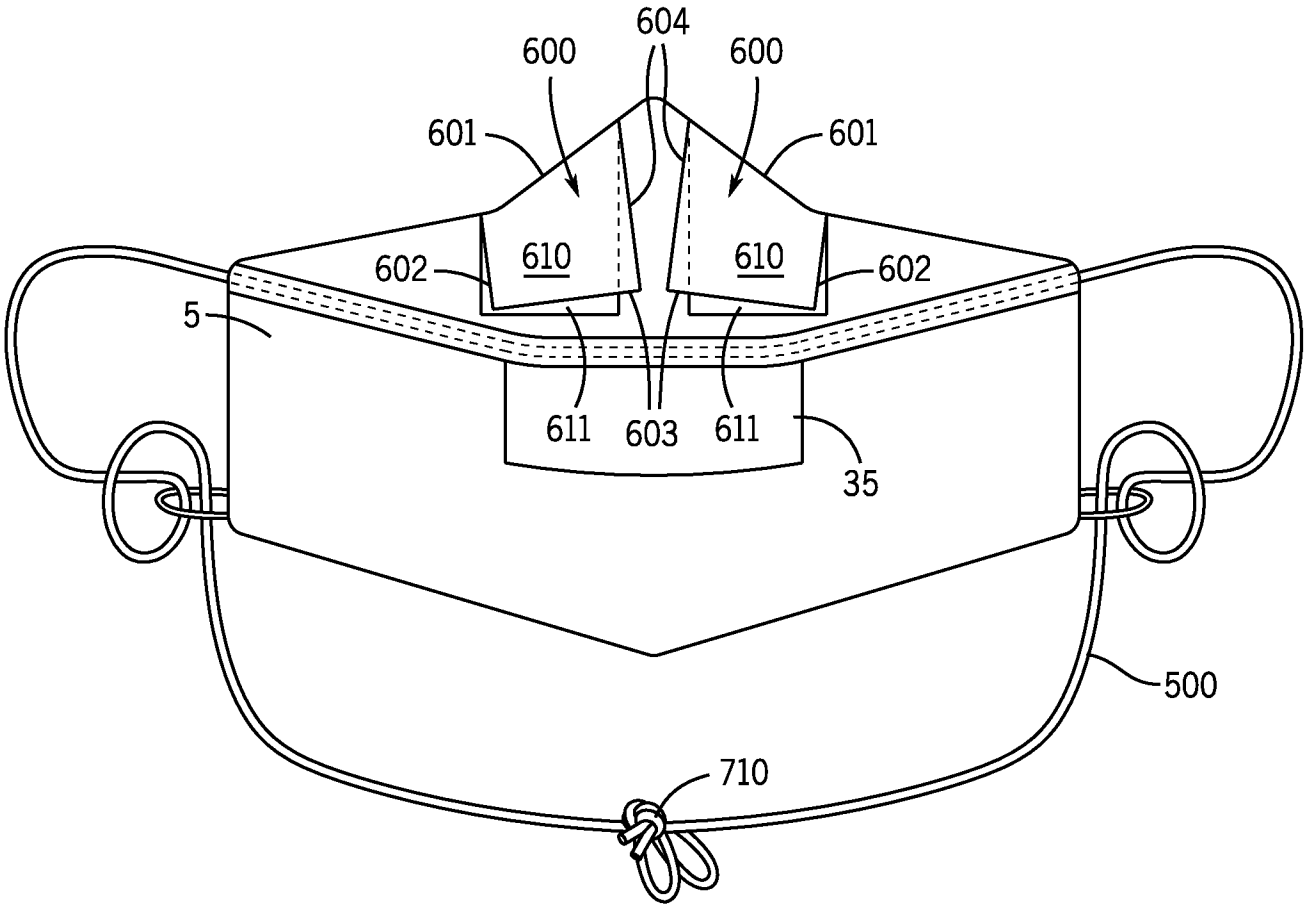
FIG. 9 illustrates the backside of the mask wherein the moisture traps are visible.

Referring now to FIG. 9, in an embodiment, the face mask 1 may have a first and a second optional moisture wicking flap 600 on the face mask 1. Each flap 600 may have a first layer 610 and a second layer 611. The first layer 610 of the first and second moisture wicking flaps 600 may each have a top 601, a bottom 603, a first side 602 and a second side 604. The moisture wicking flaps 600 may be located under the nose 10 (when worn) and help absorb moisture from the nose 10 and reduce potential fogging of eyeglasses. The moisture wicking flaps work by absorbing moisture. The moisture wicking flaps 600 may also absorb moisture and prevent air leaking upwards, thus minimizing the spread of infection and reducing the chances of the user's glasses from fogging.

The moisture wicking flaps 600 may be made of moisture wicking fabric. The first layer 610 of the first and second flap 600 may be movable while the second layer 611 of the flaps 600 may be sewn directly to the top of the mask 1 starting mid of side of the nose 10 all the way to the cheek bone. The sides 602, 604 and the bottom 603 of the first layer 610 of the flaps 600 are unsecured and are free, much similar to two flags, one side attached to the flag pole and the remaining three side free. In particular, only the top 601 of the first layer 610 of the flaps 600 are secured to the mask 1. Therefore, the first layer 610 of the flaps 600 may dangle downward. Upward moist warm air coming from the nose 10 has to go through the flaps 600, which will reduce the volume of leaked air. The flaps 600 will therein absorb some of the moisture and reduce the spread of air leak.

In one embodiment, the face mask 1 may have an adjustable ear loop string 500. In one embodiment, the ear loop string 500 is elastic so as to better force the face mask 1 against the person's face to therein reduce potential contamination by germs. The adjustable ear loop string 500 may exit a hollow fabric channel 400 of the face mask 1 at one loop 510, may travel around the ear 550 of the user, and may then pass through a second loop 520. The two-loop system 510, 520 may allow the user to more easily secure the adjustable ear loop strong 500 around the ear and secure the face mask 1 to the user. In an embodiment, a user may then tie the opposing strings 500 of the mask 1 together via a stopper 710. In an embodiment, the follow fabric channel 400 may be constructed of a moisture absorbing material. In an embodiment, the adjustable ear loop string 500 may be tightly pulled (by a user) against the face so that the nose and the mouth of the person are completely separated by the tight adjustable ear loop string 500 (and channel 400) tightly positioned on the face so that there is reduced chance of the spreading and/or receiving germs.

As visible on the back 5 of the face mask 1 as shown in FIG. 9, in an embodiment, the hollow fabric channel 400 may run between the mouth and the nose of the user. The nose compartment may be completely closed off from the mouth compartment by the constant tension of the elastic ear loop string 500 that controls both the tension under the nose 10 and around the ear or behind the head of the user. The tighter a user pulls the elastic string 500, the greater the tension in dividing the nose from the mouth. Further, the elastic string 500 allows different sized users to properly adjust the face mask 1.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A face mask comprising:

a main body panel having a front, a back, a first side, and a second side;

at least one opening on the front of the main body panel wherein the opening extends to the back of the main body panel and wherein the opening has a first side, a second side, a top, and a bottom;

a securing mechanism having a top, a first side, a second side, and wherein the securing mechanism is located next to the opening on the front of the main body panel and wherein the securing mechanism is located around the opening;

a flexible apron temporarily secured to at least the first side, the second side, or the top of the securing mechanism next to the opening on the front of the main body panel;

wherein the flexible apron may be temporarily unsecured to the securing mechanism on the first side, the second side, or the top of the securing mechanism while remaining secured to the securing mechanism at the first side, the second side, or the top of the securing mechanism;

a first moisture wicking flap secured to the back of the main body panel;

a second moisture wicking flap secured to the back of the main body panel;

wherein the first moisture wicking flap has a first layer and a second layer and wherein the first layer has a top, a bottom, a first side, and a second side and wherein only the top of the first layer is secured to the main body panel;

wherein the second moisture wicking flap has a first layer and a second layer and wherein the first layer has a top, a bottom, a first side, and a second side and wherein only the top of the first layer is secured to the main body panel;

and a hollow channel running along an entire length of the back of the main body panel wherein the hollow channel is located above the opening and below the first wicking flap and the second wicking flap and wherein the hollow channel receives a string which seals and creates a barrier between an area above the hollow channel and an area below the hollow channel when the string is tightened.

* * * * *